US005542159A

United States Patent [19]

Schultz et al.

[11] Patent Number: 5,542,159

[45] Date of Patent: Aug. 6, 1996

[54] COMBINED CHAIR GLIDE AND COUPLER

[75] Inventors: Craig H. Schultz; Ogden R. Olson, both of Muscatine, Iowa

[73] Assignee: Hon Industries Inc., Muscatine, Iowa

[21] Appl. No.: 267,444

[22] Filed: Jun. 28, 1994

[51] Int. Cl.[6] ..... A44B 21/00

[52] U.S. Cl. ..... 24/341; 24/545; 297/248; 403/389

[58] Field of Search ..... 24/339, 336, 341, 24/545, 531, 575; 297/248; 403/49, 389, 397; 248/501, 502

[56] References Cited

U.S. PATENT DOCUMENTS

| | | | |
|---|---|---|---|
| 2,540,426 | 2/1951 | Campbell | 24/341 |
| 3,162,484 | 12/1964 | Kleffman | 297/248 |
| 3,594,038 | 7/1971 | Polsky et al. | 297/248 |
| 3,614,157 | 10/1971 | Hendrickson et al. | 297/248 |
| 3,697,130 | 10/1972 | Barecki et al. | 297/248 |
| 4,045,844 | 9/1977 | Murray | 24/341 X |
| 4,602,817 | 7/1986 | Raftery | 297/248 X |
| 4,688,961 | 8/1987 | Shioda et al. | 24/575 X |
| 5,303,980 | 4/1994 | Young | 297/248 x |

FOREIGN PATENT DOCUMENTS

| | | | |
|---|---|---|---|
| 993449 | 5/1965 | United Kingdom | 297/248 |

*Primary Examiner*—James R. Brittain
*Attorney, Agent, or Firm*—Jones, Day, Reavis & Pogue

[57] ABSTRACT

A coupling member for coupling two tubular members together includes an attachment portion and a coupling portion formed integrally therewith. The attachment portion includes a member which partially wraps around the tubular member and forms a glide. The coupling portion includes a male coupling element juxtaposed next to a female coupling element. The male coupling element is receivable within a female element of a second identical coupling member and the female coupling element receives a male coupling element of the second coupling member. By this configuration, identical coupling members may be snapped to respective tubular base frames of two chairs to gang the chairs together when the coupling members are mated.

9 Claims, 3 Drawing Sheets

COMBINED CHAIR GLIDE AND COUPLER

BACKGROUND OF THE INVENTION

1. Field of the Invention

The present invention relates generally to a combined chair glide and chair coupler, and it relates more particularly to a chair glide having integrally formed coupling means for coupling to a second identical chair glide such that multiple chairs may be selectively secured together.

2. Description of the Prior Art

Chairs of the type used in meeting rooms, for example, typically are lightweight and stackable so that they can be easily stored when it is desired to use the room without seating facilities. These chairs are commonly made with round tubular frames having seats and seat backs molded from suitable plastic and secured to the frames by various mechanical fasteners. Alternatively, round steel rod or wire formed members are used for the frame.

It is often desirable to arrange the seating of meeting rooms in rows, with individual chairs positioned closely to one another. It is also desirable to gang the chairs together so that they maintain their in-line positions. Numerous arrangements are known for ganging or securing multiple chairs together. One known arrangement involves wire formed hooks which engage a mating wire hook or loop on an adjacent chair. Another arrangement involves a member which snaps over adjacent tubular members of two closely positioned chairs to secure the chairs together. However, these arrangements are relatively expensive to manufacture and are inconvenient in use.

It is, therefore, desirable to provide a combined chair glide and coupler which is formed as a single integral member and which is capable of mating to another identical glide and coupler member so as to be easily manufactured. It is further desirable to provide a combined chair glide and coupler which readily mates and unmates with a second glide and coupler so that chairs can easily be secured to one another when setting up seating in rows.

SUMMARY OF THE INVENTION

The present invention improves over the prior art by providing a coupling member for coupling two tubular members together comprising an attachment portion having a coupling portion formed integrally therewith. The attachment portion includes means for partially wrapping around the tubular member such that the coupling member snaps onto the tubular member and forms a glide. The coupling portion includes a male coupling element juxtaposed next to a female coupling element. The male coupling element is receivable within a female element of a second identical coupling member and the female coupling element receives a male coupling element of the second coupling member. By this configuration, four coupling members, all identical in shape, may be snapped to the tubular base frame of a chair such that pairs of coupling members are mateable with identical coupling members of adjacent chairs to gang multiple chairs together.

BRIEF DESCRIPTION OF THE DRAWINGS

The features and advantages of the present invention will be apparent from a reading of the following detailed description taken in connection with the accompanying drawings wherein.

DETAILED DESCRIPTION OF THE PREFERRED EMBODIMENT

Figure 1:
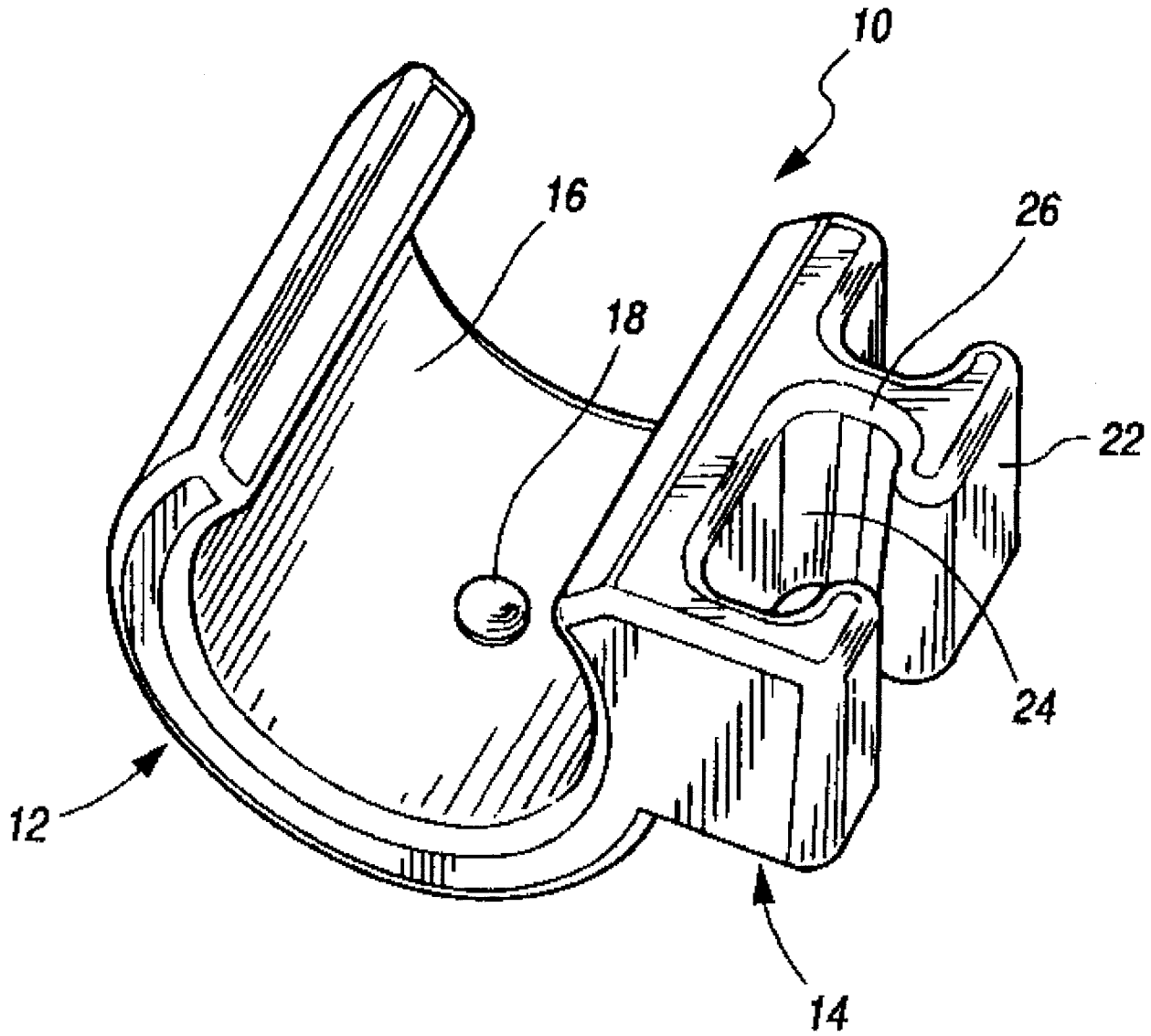
FIG. 1 is a perspective view of a combined chair glide and coupler in accordance with the present invention.
Figure 3:
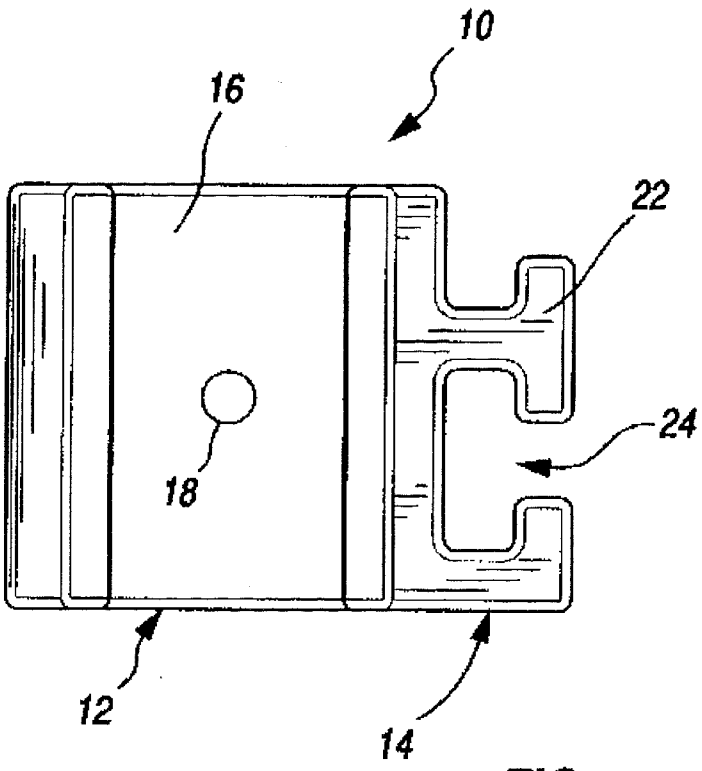
FIG. 3 is a top plan view thereof.
Figure 2:
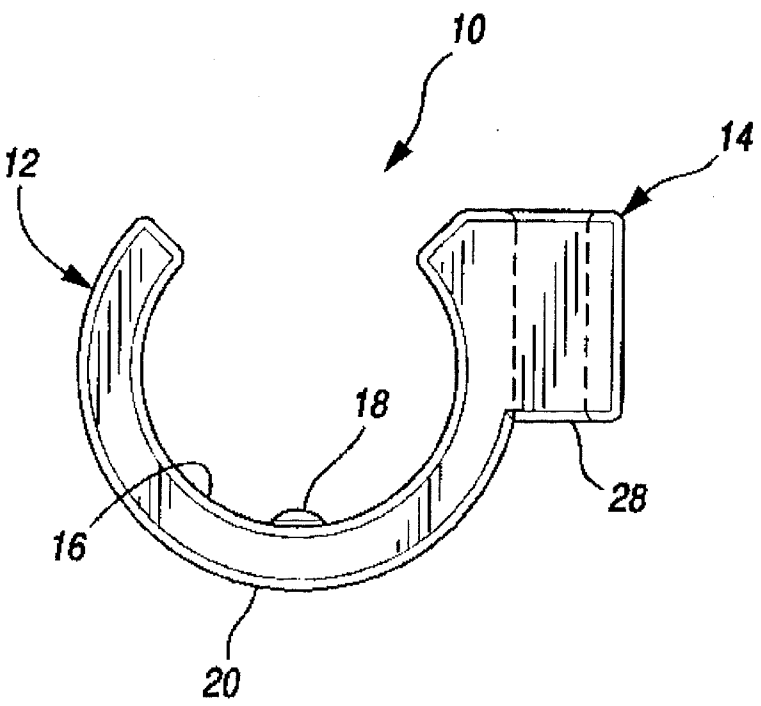
FIG. 2 is a side elevational view thereof.

Referring now to the drawings and initially to FIGS. 1–3, there is illustrated a combined chair glide and coupling member designated generally by the reference numeral 10. The glide and coupling member 10 is preferably molded from a suitable plastic such as Nylon and includes a chair attachment portion 12 and a coupling portion 14. The chair attachment portion 12 of the present embodiment is designed to attach the member 10 to a round, tubular frame member of a chair; preferably a frame member forming part of the base of the chair. To this end, the attachment portion 14 is provided with a partially cylindrical inner surface 16. In a preferred form this surface 16 forms an arc of approximately 260 degrees. The attachment portion 14 is capable of being snapped over a round tubular member and thereby secured thereto. To further secure the attachment portion 14 to the chair frame, the inner surface 16 is provided with a projection 18 which cooperates with a dimple formed in the chair frame to maintain the member 10 in proper orientation with respect to the chair frame. It can be appreciated that while the attachment portion 14 is shown as suitable for use with a round frame member, in practice the frame member may be square in cross-section or any number of other geometric shapes. The frame member may also be made of steel rod or wire-formed members. The member 10 is installed on the chair frame such that surface 20 of the attachment portion 14 faces downwardly, thereby providing a glide.

Referring still to FIGS. 1—3, the coupling portion 14 of the combined glide and coupler member 10 can be seen to include an integrally formed outward projection of the attachment portion 12. The coupling portion 14 comprises two distinct elements; a male coupling element 22 and a female coupling element 24. Both of these elements 22 and 24 are T-shaped in cross-section in the preferred embodiment. However, other shapes may be used provided the male element 22 is capable of being slidingly receivable by the female element 24 and the shapes cooperate geometrically to interlock when two identical members 10 are mated with one another. Preferably, edges 26 of the female element 24 and edges 28 of the male element 22 are chamfered to easily center and mate with one another.

Figure 4:
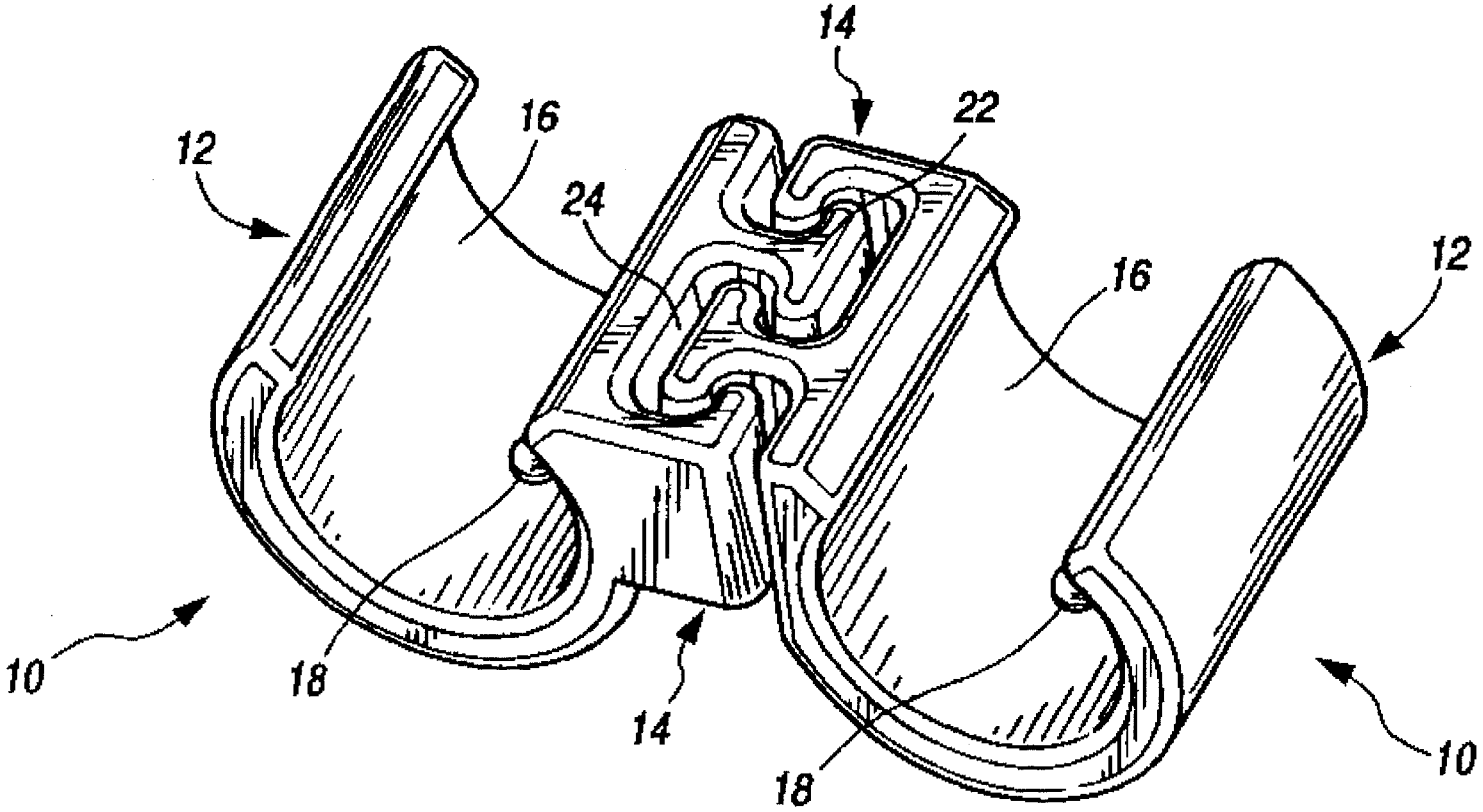
FIG. 4 is a top plan view of two coupler members shown coupled together.

Turning now to FIG. 4, a pair of combined glide and coupler members 10 are shown in interlocking relation, with respective male coupler elements 22 received within female coupler elements 24. It can now be appreciated that glide and coupler member 10 is easily manufactured by injection molding and provides a highly effective chair glide while also serving as a coupling member for ganging chairs together. Because the member 10 is essentially mateable with itself, the prior art arrangement of requiring two separate and different interlocking members is avoided, thereby saving on manufacturing costs.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A combined chair glide and coupler member comprising:

an attachment portion configured for attachment of said chair glide and coupler member to a horizontal portion of a tubular base member of a chair with a surface of said attachment portion providing a floor glide for said base member; and a coupling portion extending laterally from said attachment portion and including a male projecting element juxtaposed next to a female recess element;

said male and female coupling elements being dimensioned and configured to mate with corresponding female and male coupling elements, respectively, of a second like chair glide and coupler member and said coupler elements being juxtaposed next to each other along an axis disposed generally parallel to said tubular base member when said chair glide and coupler is attached thereto, wherein said respective coupling elements are mated by relative movement of two said chair glide and coupler members in a direction generally normal to the plane of a floor on which said base member of said chair is supported.

2. The combined chair glide and coupler member of claim 1 wherein said male coupling element is generally T-shaped in cross-section.

3. The combined chair glide and coupler member of claim 1 wherein said female coupling element is generally T-shaped in cross-section.

4. The combined chair glide and coupler member of claim 1 wherein said male coupling element of a first chair glide and coupler member is slidingly receivable within said female coupling element of said second like chair glide and coupler member.

5. The combined chair glide and coupler member of claim 1 wherein the edges of said male coupling element are chamfered.

6. The combined chair glide and coupler member of claim 1 wherein the edges of said female coupling element are chamfered.

7. The combined chair glide and coupler member of claim 1 wherein said attachment portion is integrally formed with said coupling portion.

8. The combined chair glide and coupler member of claim 1 said attachment portion includes a projection and said projection cooperates with a recess in said tubular member for securing said combined chair glide and coupler member to said tubular member.

9. The combined chair glide and coupler member of claim 1 wherein said attachment portion is partially cylindrical and configured to snap around a round tubular member.

* * * * *